US012121129B2

(12) United States Patent
Loke et al.

(10) Patent No.: US 12,121,129 B2
(45) Date of Patent: Oct. 22, 2024

(54) METHOD OF CONTROLLING A HAIRCARE APPLIANCE

(71) Applicant: Dyson Technology Limited, Wiltshire (GB)

(72) Inventors: Siew Ling Loke, Singapore (SG); Li Niu, Singapore (SG)

(73) Assignee: Dyson Technology Limited, Wiltshire (GB)

( * ) Notice: Subject to any disclaimer, the term of this patent is extended or adjusted under 35 U.S.C. 154(b) by 886 days.

(21) Appl. No.: 17/274,661

(22) PCT Filed: Sep. 5, 2019

(86) PCT No.: PCT/GB2019/052473

§ 371 (c)(1),
(2) Date: Mar. 9, 2021

(87) PCT Pub. No.: WO2020/053553

PCT Pub. Date: Mar. 19, 2020

(65) Prior Publication Data

US 2021/0251362 A1 Aug. 19, 2021

(30) Foreign Application Priority Data

Sep. 10, 2018 (GB) ..... 1814658

(51) Int. Cl.
*A45D 20/08* (2006.01)

(52) U.S. Cl.
CPC ..... *A45D 20/08* (2013.01); *A45D 2200/15* (2013.01)

(58) Field of Classification Search
CPC ..... A45D 20/08; A45D 20/30; A45D 20/12; A45D 2200/15
See application file for complete search history.

(56) References Cited

U.S. PATENT DOCUMENTS 3,625,630 A 12/1971 Soo
5,790,749 A 8/1998 Polaert et al.
(Continued)

FOREIGN PATENT DOCUMENTS

CN 202031853 U 2/1989
CN 101936599 A 1/2011
(Continued)

OTHER PUBLICATIONS

Office Action received for Chinese Patent Application No. 201980058861.6, mailed on Oct. 25, 2023, 23 pages (13 pages of English Translation and 10 pages of Original Document).
(Continued)

*Primary Examiner* — Shawntina T Fuqua
(74) *Attorney, Agent, or Firm* — Tucker Ellis LLP

(57) ABSTRACT

Disclosed herein is a method of controlling a haircare appliance including a heater. The method includes measuring a temperature of output air of the haircare appliance to obtain a measured output air temperature. The method includes comparing the measured output air temperature to a desired output air temperature. The method includes determining a desired heater temperature based on the comparison of the measured output air temperature to the desired output air temperature. The method includes predicting a predicted heater temperature. The method includes comparing the predicted heater temperature to the desired heater temperature. The method includes outputting a control signal based on the comparison of the predicted heater temperature to the desired heater temperature.

21 Claims, 7 Drawing Sheets

(56) References Cited

U.S. PATENT DOCUMENTS

| | | | | |
|---|---|---|---|---|
| 2011/0047812 | A1* | 3/2011 | Sugimoto | D06F 58/38 454/313 |
| 2019/0357653 | A1* | 11/2019 | Guerreiro | A45D 1/00 |
| 2024/0138538 | A1* | 5/2024 | Kim | A45D 20/12 |
| 2024/0164503 | A1* | 5/2024 | Lelieveld | A45D 20/12 |

FOREIGN PATENT DOCUMENTS

| | | | | |
|---|---|---|---|---|
| CN | 204949893 | U | 1/2016 | |
| CN | 106617613 | A | 5/2017 | |
| CN | 107397323 | A | 11/2017 | |
| DE | 4340161 | B4 | 1/2010 | |
| DE | 102014110061 | A1 | 1/2016 | |
| EP | 1086630 | A2 * | 3/2001 | A45D 20/12 |
| EP | 2282139 | A2 * | 2/2011 | F24H 3/0423 |
| EP | 2048565 | B1 | 6/2013 | |
| EP | 2676567 | A1 | 12/2013 | |
| FR | 2688075 | A1 | 9/1993 | |
| FR | 3040092 | A1 | 2/2017 | |
| GB | 2433886 | A | 7/2007 | |
| JP | S54-152205 | A | 11/1979 | |
| JP | 62-123257 | A | 6/1987 | |
| JP | S64-15005 | A | 1/1989 | |
| JP | 07-236699 | A | 9/1995 | |
| JP | 3278807 | B2 | 2/2002 | |
| JP | 3776297 | B2 | 3/2006 | |
| JP | 3829575 | B2 | 10/2006 | |
| JP | 2011-005150 | A | 1/2011 | |
| JP | 5295012 | B2 | 6/2013 | |
| JP | 2014-516742 | A | 7/2014 | |
| JP | 2017-077470 | A | 4/2017 | |
| KR | 10-2005-0029960 | A | 3/2005 | |
| RU | 2009111931 | A | 10/2010 | |
| WO | WO-9531915 | A1 * | 11/1995 | A45D 20/30 |
| WO | 2004/012554 | A2 | 2/2004 | |
| WO | 2017/068320 | A1 | 4/2017 | |

OTHER PUBLICATIONS

Office Action received for Korean Patent Application No. 10-2021-7009637, mailed on Sep. 16, 2022, 16 pages (8 pages of English Translation and 8 pages of Original Document).

International Search Report and Written Opinion dated Nov. 26, 2019, directed to International Application No. PCT/GB2019/052473; 9 pages.

Search Report dated Feb. 20, 2019, directed to GB Application No. 1814658.9; 1 page.

Office Action received for Japanese Patent Application No. 2021-513210, mailed on Apr. 19, 2022, 3 pages (1 page of English Translation and 2 pages of Original Document).

* cited by examiner

METHOD OF CONTROLLING A HAIRCARE APPLIANCE

REFERENCE TO RELATED APPLICATIONS

This application is a national phase application under 35 USC 371 of International Application No. PCT/GB2019/052473, filed Sep. 5, 2019, which claims the priority of United Kingdom Application No. 1814658.9, filed Sep. 10, 2018, the entire contents of each of which are incorporated herein by reference.

FIELD OF THE DISCLOSURE

The present invention relates to a method of controlling a haircare appliance, and more particularly to a method of controlling a haircare appliance comprising a heater.

BACKGROUND OF THE DISCLOSURE

Haircare appliances, for example hairdryers or hot styling brushes, typically comprise a heater for heating air flowing through the appliance. It has previously been proposed to control the heater of a haircare appliance such that the temperature of air output by the appliance is kept at a desired level.

SUMMARY OF THE DISCLOSURE

According to a first aspect of the present invention there is provided a method of controlling a haircare appliance comprising a heater, wherein the method comprises measuring a temperature of output air of the haircare appliance to obtain a measured output air temperature, comparing the measured output air temperature to a desired output air temperature, determining a desired heater temperature based on the comparison of the measured output air temperature to the desired output air temperature, predicting a predicted heater temperature, comparing the predicted heater temperature to the desired heater temperature, and outputting a control signal based on the comparison of the predicted heater temperature to the desired heater temperature.

The method according to the first aspect of the present invention may be advantageous principally as the method comprises determining a desired heater temperature based on the comparison of the measured output air temperature to the desired output air temperature, predicting a predicted heater temperature, comparing the predicted heater temperature to the desired heater temperature, and outputting a control signal based on the comparison of the predicted heater temperature to the desired heater temperature.

In particular, outputting a control signal based on the comparison of the predicted heater temperature to the desired heater temperature may provide a more responsive and/or more accurate system than, for example, a system where a control signal is output solely based on a comparison of a measured output temperature to a desired output temperature. Where a control signal is output solely based on a comparison of a measured output temperature to a desired output temperature, there may be a large time delay due to the thermal masses of components of the heater. A large time delay may result in a large overshoot of the desired temperature. By predicting the heater temperature, the method according to the first aspect of the present invention may reduce any time delay, and so may reduce the risk of temperature overshoot occurring in use. Predicting a predicted heater temperature may also avoid the need to measure the heater temperature, which may remove the need to use an additional temperature sensor, and hence achieve a more responsive and/or more accurate system for little or no additional cost.

Predicting a predicted heater temperature may comprise utilising a pre-determined simulation or map or look-up table of heater parameters, for example a pre-determined simulation or map or look-up table of heater component thermal coefficients or the like. Predicting a predicted heater temperature may comprise utilising a pre-stored look-up table of measured output air temperature vs predicted heater temperature. This may be beneficial as it may remove the need for a controller of the haircare appliance to perform real time calculations, thereby reducing any delay and reducing the risk of temperature overshoot.

The method may comprise using the measured output air temperature to predict the predicted heater temperature. Using the measured output air temperature to predict a predicted heater temperature may avoid the need to utilise an additional temperature sensor to measure the temperature of the heater, and hence the additional cost and or/complexity of including an additional temperature sensor may be avoided. By utilising an already measured parameter, i.e. the measured output air temperature, a more responsive and/or more accurate system may be achieved for little or no additional cost.

The control signal may comprise a power control signal for adjusting power supplied to the heater. The control signal may comprise a heater timing parameter, for example a parameter which defines when and/or how long for power is supplied to the heater. The control signal may comprise a duty cycle, for example a percentage of a cycle of a waveform of a power supply over which power is supplied to the heater. The control signal may comprise a phase angle, for example an angle of a waveform of a power supply at which a switch of the heater begins to conduct power to the heater. The control signal may control a switch, for example a TRIAC, of the heater.

The method may comprise increasing power supplied to the heater where the predicted heater temperature is lower than the desired heater temperature and/or decreasing power supplied to the heater where the predicted heater temperature is higher than the desired heater temperature.

Determining a desired heater temperature based on the comparison of the measured output air temperature to the desired output air temperature may comprise calculating an error value corresponding to a difference between the measured output air temperature and the desired output air temperature, and calculating a desired heater temperature to offset the error value. Determining a desired heater temperature based on the comparison of the measured output air temperature to the desired output air temperature may comprise utilising a first control compensator, for example a first PI (proportional integral) controller. The first control compensator may comprise an input corresponding to an error value that is a difference between the measured output air temperature and the desired output air temperature, and the first control compensator may calculate a desired heater temperature to offset the error value.

Outputting a control signal based on the comparison of the predicted heater temperature to the desired heater temperature may comprise calculating an error value corresponding to a difference between the predicted heater temperature and the desired heater temperature, and calculating a control signal to offset the error value. Outputting a control signal based on the comparison of the predicted heater temperature to the desired heater temperature may comprise utilising a second control compensator, for example a second PI controller. The second control compensator may comprise an input corresponding to an error value that is a difference between the predicted heater temperature and the desired heater temperature, and the second control compensator may calculate a control signal to offset the error value.

An output of the first control compensator may comprise an input of the second control compensator. The first and second control compensator may comprise a cascaded control system, for example a cascaded PI control system.

The method may comprise a first control loop and a second control loop, the first control loop comprising measuring a temperature of output air of the haircare appliance to obtain a measured output air temperature, comparing the measured output air temperature to a desired output air temperature, and determining a desired heater temperature based on the comparison of the measured output air temperature to the desired output air temperature, and the second control loop comprising predicting a heater temperature, comparing the predicted heater temperature to the desired heater temperature, and outputting a control signal based on the comparison of the predicted heater temperature to the desired heater temperature.

The first control loop may comprise an outer control loop, and the second control loop may comprise an inner control loop. The first control loop may be slower than the second control loop.

The heater may comprise a heater trace, and the method may comprise determining a desired heater trace temperature based on the comparison of the measured output air temperature to the desired output air temperature, predicting a predicted heater trace temperature, comparing the predicted heater trace temperature to the desired heater trace temperature, and outputting a control signal based on the comparison of the predicted heater trace temperature to the desired heater trace temperature. This may be beneficial as it may be difficult to place a temperature sensor on or in close proximity to a heater trace, for example due to insulation requirements and manufacturability. Thus by predicting a predicted heater trace temperature the need to attempt to place a temperature sensor on or in close proximity to the heater trace may be avoided.

Predicting a predicted heater trace temperature may comprise using the measured output air temperature to predict a predicted heater trace temperature. This may be beneficial as it may avoid the need to introduce a further temperature sensor to predict the predicted heater trace temperature.

The heater may comprise a heat sink, and predicting a predicted heater trace temperature may comprise using a measured heat sink temperature. This may be beneficial over, for example, using the measured output air temperature, as the airflow may impact on the accuracy of the temperature measurement, and so using a measured heat sink temperature may provide a more accurate predicted heater trace temperature.

The heater may comprise a ceramic plate to which the heater trace is attached, and predicting a predicted heater trace temperature may comprise using a measured ceramic plate temperature. This may be beneficial over, for example, using the measured air output temperature, as the airflow may impact on the accuracy of the temperature measurement, and so using a measured ceramic plate temperature may provide a more accurate predicted heater trace temperature. Furthermore, the ceramic plate may comprise a pre-existing temperature sensor, for example for thermal safety reasons, and hence using a measured ceramic plate temperature may provide a more accurate predicted heater trace temperature without incurring the cost and/or complexity of an additional temperature sensor.

The heater may comprise a plurality of heater traces, and the method may comprise determining a desired average heater trace temperature based on the comparison of the measured output air temperature to the desired output air temperature, predicting a predicted average heater trace temperature, comparing the predicted average heater trace temperature to the desired average heater trace temperature, and outputting a control signal based on the comparison of the predicted average heater trace temperature to the desired average heater trace temperature. Predicting a predicted average heater trace temperature may be beneficial as it may avoid the need to use multiple individual temperature sensors, for example one for each heater trace. This may provide a reduced cost relative to an arrangement which requires a temperature sensor for each heater trace.

Predicting a predicted average heater trace temperature may comprise using the measured output air temperature to predict a predicted average heater trace temperature. This may be beneficial as it may avoid the need to introduce a further temperature sensor to predict the predicted average heater trace temperature.

The heater may comprise a heat sink, and predicting a predicted average heater trace temperature may comprise using a measured heat sink temperature. This may be beneficial over, for example, using the measured air output temperature, as the airflow may impact on the accuracy of the temperature measurement, and so using a measured heat sink temperature may provide a more accurate predicted average heater trace temperature.

The heater may comprise a ceramic plate to which the heater trace is attached, and predicting a predicted average heater trace temperature may comprise using a measured ceramic plate temperature. This may be beneficial over, for example, using the measured air output temperature, as the airflow may impact on the accuracy of the temperature measurement, and so using a measured ceramic plate temperature may provide a more accurate predicted average heater trace temperature. Furthermore, the ceramic plate may comprise a pre-existing temperature sensor, for example for thermal safety reasons, and hence using a measured ceramic plate temperature may provide a more accurate predicted average heater trace temperature without incurring the cost and/or complexity of an additional temperature sensor.

The control signal may comprise a power control signal for adjusting power supplied to the heater trace. The control signal may adjust power supplied to each heater trace such that the power supplied to each heater trace is adjusted in a substantially even manner, for example the power supplied to each heater trace is increased or decreased by a substantially even amount.

According to a further aspect of the present invention there is provided a data carrier comprising machine readable instructions for the operation of one or more processors of a controller of a haircare appliance to measure a temperature of output air of the haircare appliance to obtain a measured output air temperature, compare the measured output air temperature to a desired output air temperature, determine a desired heater temperature based on the comparison of the measured output air temperature to the desired output air temperature, predict a predicted heater temperature, compare the predicted heater temperature to the desired heater temperature, and output a control signal based on the comparison of the predicted heater temperature to the desired heater temperature.

According to a further aspect of the present invention there is provided a haircare appliance comprising a heater, a temperature sensor for measuring a temperature of output air of the haircare appliance, and a controller configured to measure a temperature of output air of the haircare appliance to obtain a measured output air temperature, compare the measured output air temperature to a desired output air temperature, determine a desired heater temperature based on the comparison of the measured output air temperature to the desired output air temperature, predict a predicted heater temperature, compare the predicted heater temperature to the desired heater temperature, and output a control signal based on the comparison of the predicted heater temperature to the desired heater temperature.

The haircare appliance may, for example, comprise a hairdryer or a hot styling brush.

Preferential features of aspects of the present invention may be equally applied to other aspects of the present invention, where appropriate.

BRIEF DESCRIPTION OF THE FIGURES

In order to better understand the present invention, and to show more clearly how the invention may be put into effect, the invention will now be described, by way of example, with reference to the following drawings.

DETAILED DESCRIPTION OF THE DISCLOSURE

Figure 1:
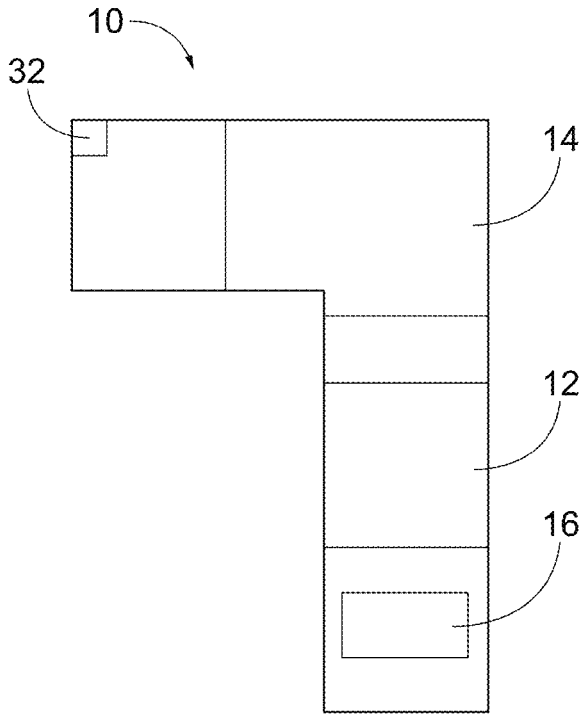
FIG. 1 is a schematic cross-sectional view of a haircare appliance according to the present invention.

A haircare appliance, in the form of a hairdryer, generally designated 10, is shown schematically in FIG. 1. The hairdryer 10 comprises a motor 12, a heater 14, and a controller 16. Details of the motor 12 are not pertinent to the present invention, and will not be included here for the sake of brevity, save to say that the motor 12 generates airflow through the hairdryer 10 in use. A suitable motor 12 may, for example, be the motor disclosed in published PCT patent application WO2017/098200.

Figure 2:
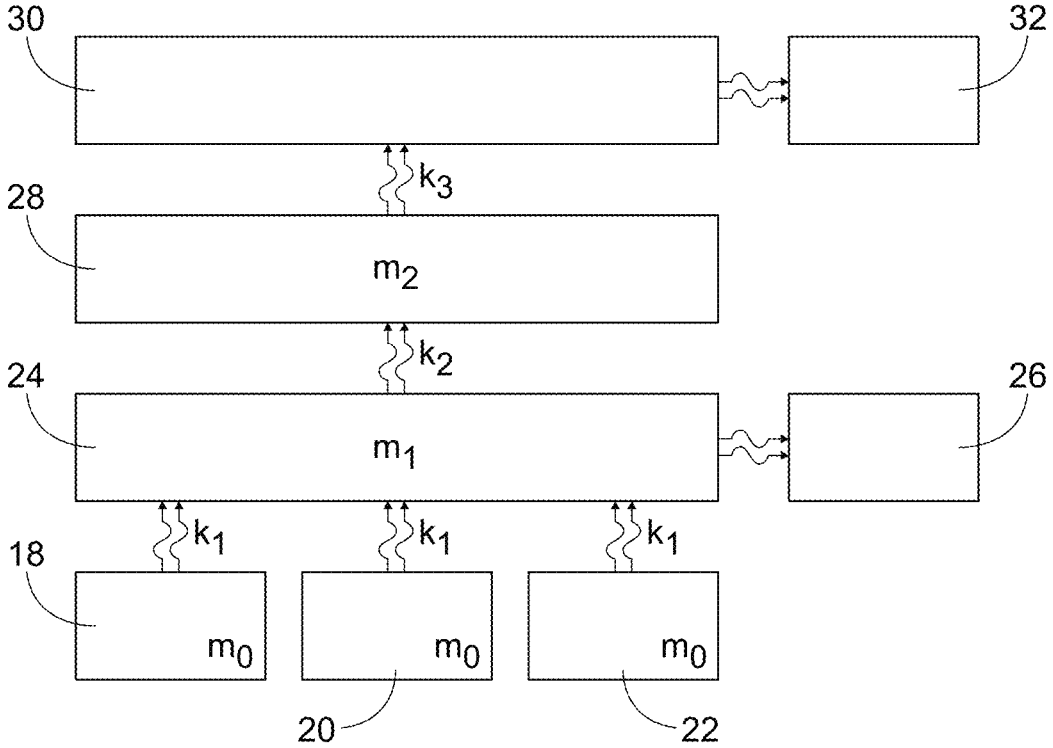
FIG. 2 is a schematic representation of a heater of the haircare appliance of FIG. 1.

The heater 14 is shown schematically in isolation in FIG. 2, and comprises three heater traces 18,20,22, a ceramic heater plate 24, a resistance temperature detector (RTD) 26, and a heat sink 28. The three heater traces 18,20,22 are formed of tungsten, and sit on the ceramic heater plate 24. The RTD 26 is connected to the ceramic heater plate 24, such that the RTD 26 is able to provide a measure of the temperature of the ceramic heater plate 24 in use. The RTD 26 may also be used as part of a thermal safety system. Although shown here as an RTD, it will be appreciated by a person skilled in the art that any appropriate temperature sensor may be used. The heat sink 28 is connected to the ceramic heater plate 24.

The thermal structure of the heater 14 can also be seen schematically in FIG. 2. Each heater trace 18,20,22 has a thermal mass $m_0$, the ceramic heater plate 24 has a thermal mass $m_1$, and the heat sink 28 has a thermal mass $m_2$. The thermal conduction coefficient between each heater trace 18,20,22 and the ceramic heater plate 24 is denoted $k_1$, the thermal conduction coefficient between the ceramic heater plate 24 and the heat sink 26 is denoted k2, and the thermal conduction coefficient between the heat sink 26 and output airflow 30 is denoted k3. A thermistor 32 is located near an outlet of the hairdryer 10 for measuring the temperature of the output airflow 30.

The controller 16 may be any appropriate controller. Details of the control performed by the controller 16 are described in more detail hereafter. The controller 16 is disposed within the main body of the hairdryer 10.

Figure 3:
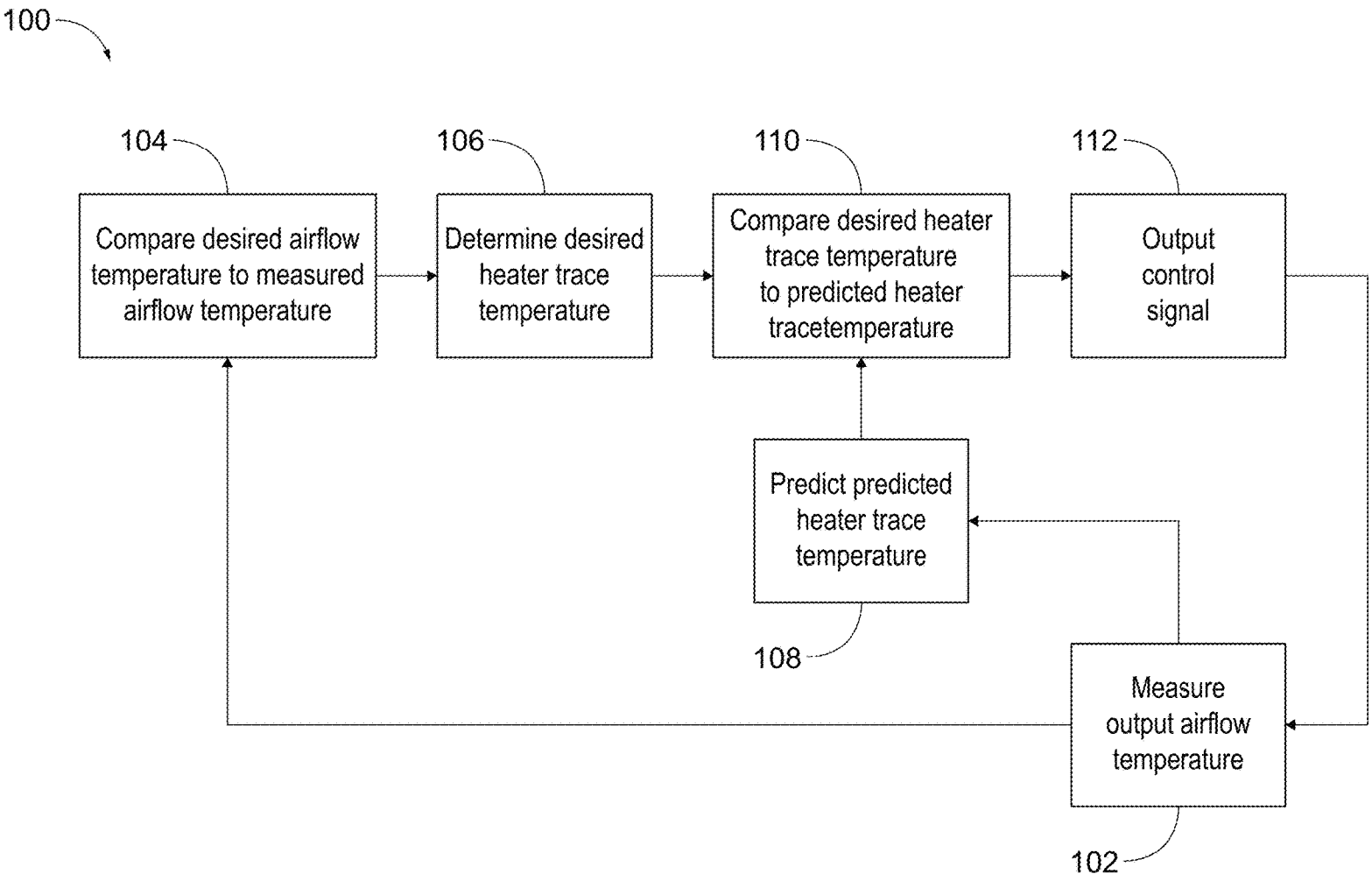
FIG. 3 is a flow chart illustrating a first embodiment of a method of controlling a haircare appliance according to the present invention.

A first embodiment of a method 100 of controlling the hairdryer 10 according to the present invention can be seen schematically from the flow diagram of FIG. 3. The method 100 comprises measuring 102 a temperature of output airflow 30 of the hairdryer 10 to obtain a measured output airflow temperature. The measured output airflow temperature is compared 104 to a desired output airflow temperature, which may, for example, be set by a user choosing a mode of operation of the hairdryer 10 such as a heat setting. Based on this comparison, the controller 16 determines 106 a desired heater trace temperature to account for any difference between the measured output airflow temperature and the desired output airflow temperature, and the controller 16 predicts 108 a heater trace temperature based on the measured output airflow temperature. The controller 16 compares 110 the predicted heater trace temperature to the desired heater trace temperature, and outputs 112 a control signal to TRIACs (not shown) of the heater 14 to control the power supplied to the heater traces 18,20,22. In such a manner the method 100 may closely control the output airflow temperature via close control of the heater temperature, based on a predicted heater trace temperature determined by the measured output airflow temperature. The method 100 thus comprises two closed feedback loops, an outer feedback loop which controls the output airflow temperature, and an inner feedback loop which controls the heater trace temperature.

Figure 4:
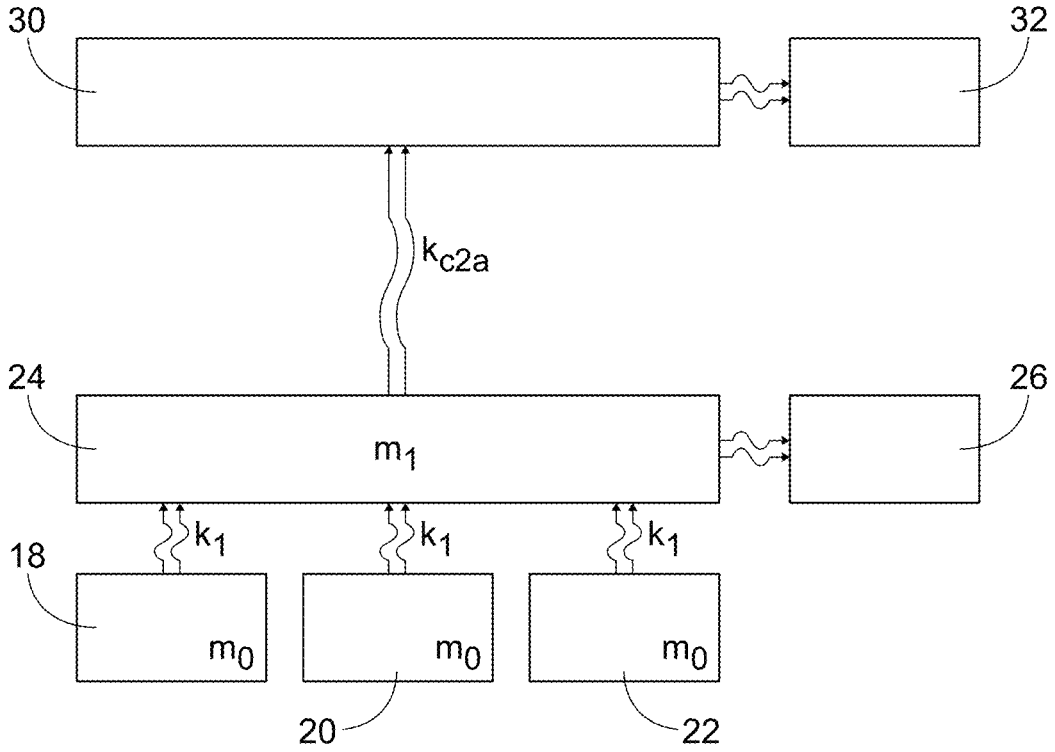
FIG. 4 is a first simplified version of the schematic heater representation of FIG. 2.

The method 100 described above relies on being able to predict a heater trace temperature using a measured output airflow temperature. This is achieved via a simplification of the schematic heater structure of FIG. 2, the simplification being shown in FIG. 4. In particular, using computational fluid dynamics (CFD) simulation data, it is possible to obtain a direct relationship between the output airflow 30 and the ceramic heater plate 24, which enables the thermal conduction coefficient between the ceramic heater plate 24 and the output airflow 30, $k_{c2a}$, to be obtained as a function of the measured output airflow temperature and the output airflow rate.

Assuming no energy loss in the system, $k_{c2a}$ can be defined as:

$$k_{c2a} = \frac{\text{Power}}{T_{ceramic} - T_{avgairflow}}$$

where $T_{ceramic}$ is the temperature of the ceramic heater plate 24, and $T_{avgairflow}$ is the average output airflow temperature (both measured in ° C.).

Figure 5A:
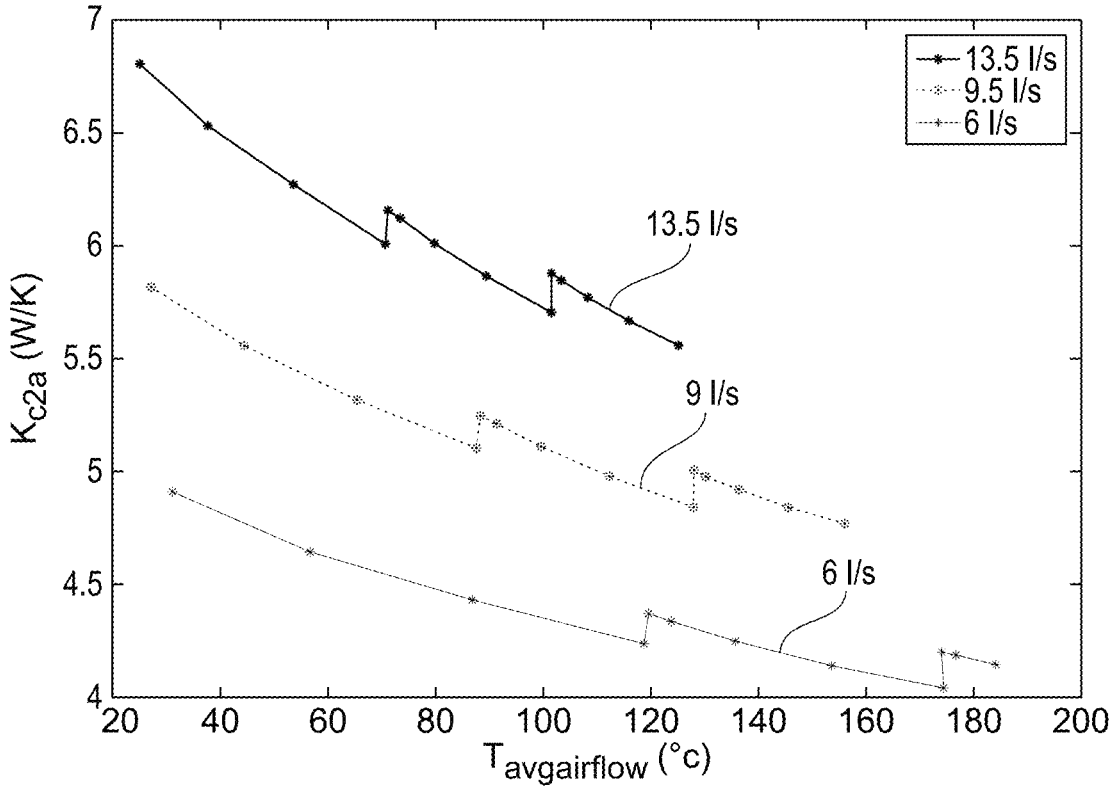
FIG. 5*a* is a plot of average output airflow temperature versus thermal conduction coefficient for three flow rates.
Figure 5B:
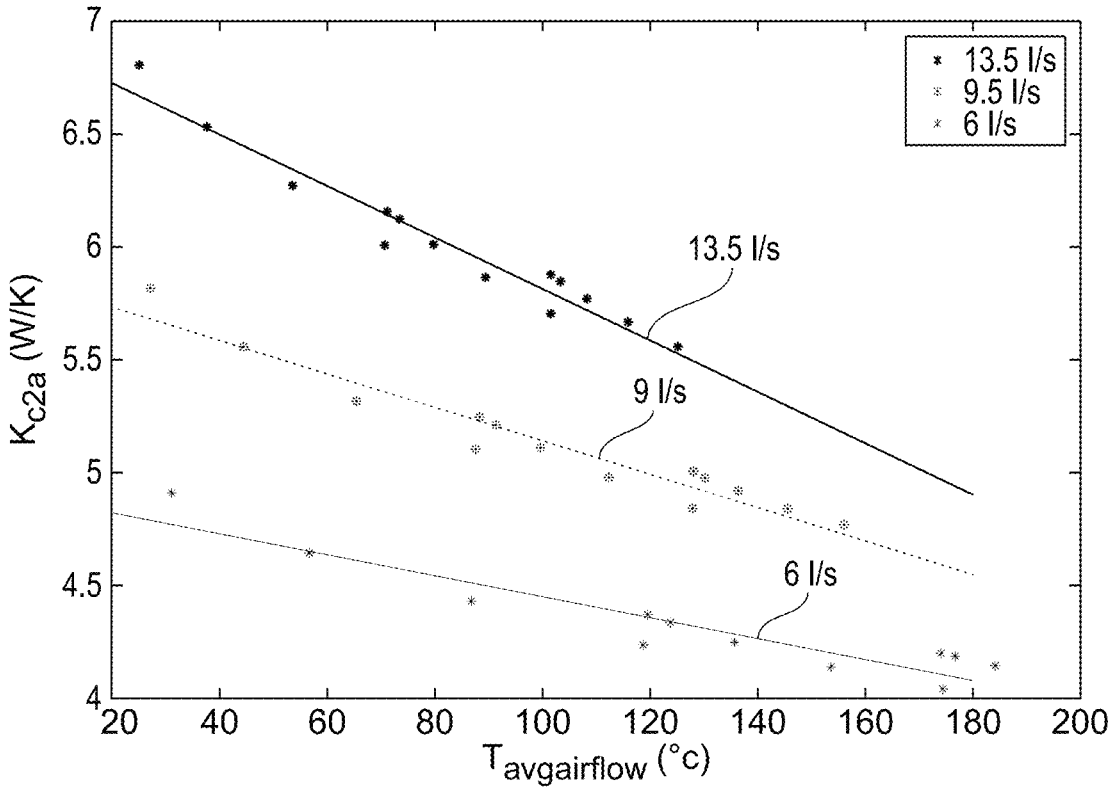
FIG. 5*b* is a plot of curve fittings of the plot of FIG. 5*a;*

A plot of $k_{c2a}$ versus $T_{avgairflow}$, for three different airflow rates, is shown in FIG. 5*a*. Applying curve fitting for each flow rate, i.e. $k_{c2a}=k_{11}\cdot T_{avgairflow}+k_{12}$, gives the following equations:

$k_{c2a}=-0.0114\cdot T_{avgairflow}+6.954$ where airflow is 13.5 l/s $k_{c2a}=-0.007398\cdot T_{avgairflow}+5.881$ where airflow is 9.5 l/s $k_{c2a}=-0.004639\cdot T_{avgairflow}+4.916$ where airflow is 6 l/s These fitted curves are shown in FIG. 5*b*.

Performing curve fitting for the equation $k_{c2a}=k_{11}\cdot T_{avgairflow}+k_{12}$ then allows the coefficients kn and $k_{12}$ to be determined as follows:

$$k_{11}=-9.038\times10^{-4}\cdot Q+9.245\times10^{-4}$$

$$k_{12}=0.2717\cdot Q+3.291$$

where Q is the airflow rate in litres per second.

This then gives the following relationship for the thermal conduction coefficient between the ceramic heater plate 24 and the output airflow 30, $k_{c2a}$, as a function of the measured output airflow temperature and the output airflow rate:

$$k_{c2a}=(-9.038\times10^{-4}\cdot Q+9.245\times10^{-4})\cdot T_{avgairflow}+(0.2717\cdot Q)+3.291$$

Figure 6A:
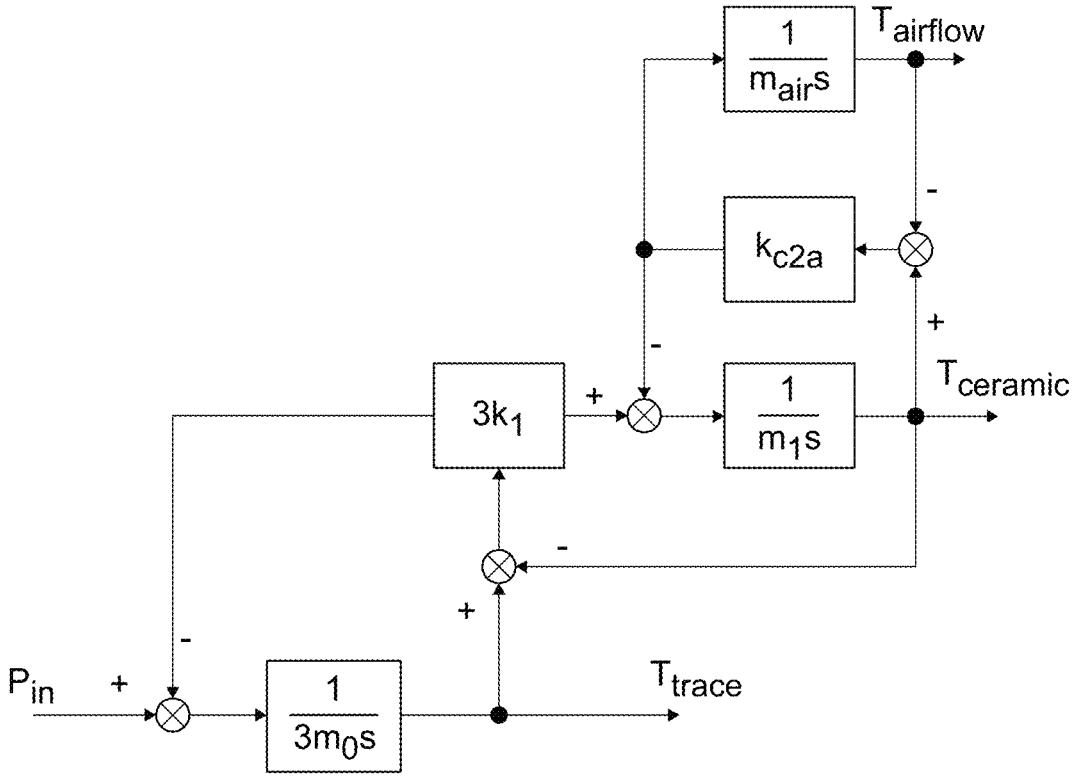
FIG. 6*a* is a partial control block diagram of the method of FIG. 3.

The relationship between the output airflow temperature $T_{airflow}$ and the heater trace temperature $T_{trace}$ can be seen in FIG. 6*a* in a control block diagram in the frequency domain. This relationship relies on both the thermal conduction coefficient between the ceramic heater plate 24 and the output airflow 30, $k_{c2a}$, and the thermal conduction coefficients between the heater traces 18,20,22 and the ceramic heater plate 24, $k_1$. The relationship also relies on the thermal masses of the heater traces 18,20,22, $m_0$, the ceramic heater plate 24, $m_1$, and the output airflow 30, $m_{air}$.

Figure 6B:
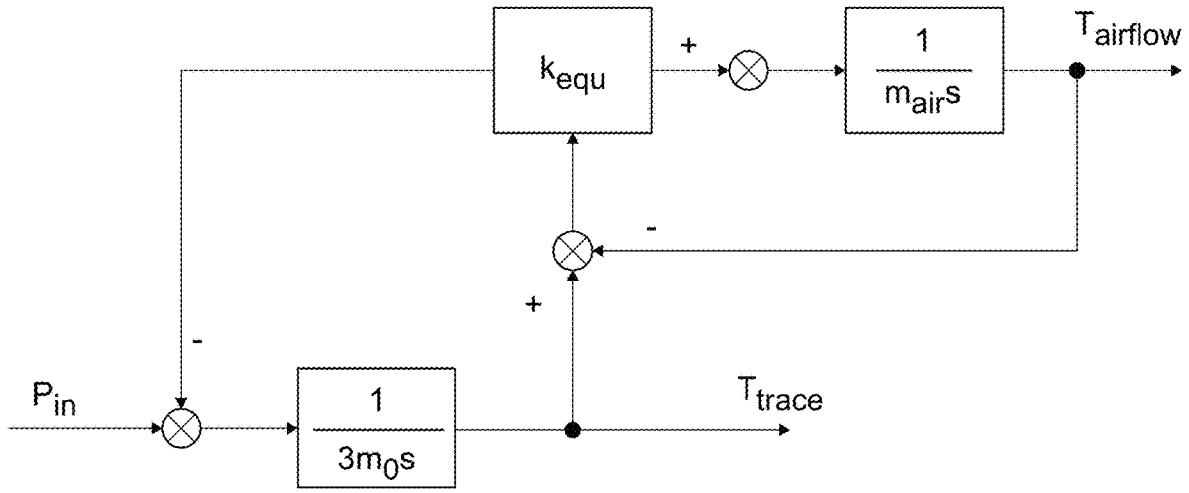
FIG. 6*b* is a simplified version of the partial control block diagram of FIG. 6*a;*

This relationship can be simplified, as shown in FIG. 6*b* in a control block diagram in the frequency domain, via the introduction of an equivalent thermal conduction coefficient between the heater traces 18,20,22 and the output airflow 30, $k_{equ}$, and the introduction of an equivalent thermal mass of the heater traces 18,20,22 and the ceramic heater plate 24, $m_{equ}$. The equivalent thermal mass $m_{equ}$ in the present case is set to $3m_0$, i.e. three times the thermal mass of an individual heater trace 18,20,22, although this can be adjusted, if necessary.

The equivalent thermal conduction coefficient, $k_{equ}$, can be calculated as follows. Temperature relationships of the heater trace temperature $T_{trace}$ and the output airflow temperature $T_{airflow}$ are shown below:

$$\frac{P_{in} - (T_{trace} - T_{ceramic})\cdot 3k_1}{s\cdot 3m_0} = T_{trace}$$

-continued $$\frac{(T_{trace} - T_{ceramic})\cdot 3k_1 - (T_{ceramic} - T_{airflow})\cdot k_{c2a}}{s\cdot m_1} = T_{airflow}$$

where s is the differential operator, for example d/dt, and $P_{in}$ is the input power.

Combining these two temperature relationships gives:

$$\frac{P_{in} - \frac{(k_{c2a} - s\cdot m_1)\cdot T_{trace} - k_{c2a}\cdot T_{airflow}}{3k_1 + k_{c2a} + s\cdot m_1}\cdot 3k_1}{s\cdot 3m_0} = T_{trace}$$

Treating differential terms as zero gives:

$$\frac{P_{in} - \frac{3k_1\cdot k_{c2a}}{3k_1 + k_{c2a}}(T_{trace} - T_{airflow})}{s\cdot 3m_0} = T_{trace}$$

Thus we can derive the equivalent thermal conduction coefficient as $$k_{equ} = \frac{3k_1\cdot k_{c2a}}{3k_1 + k_{c2a}}$$

and the relationship between the output airflow temperature $T_{airflow}$ and the heater trace temperature $T_{trace}$ can be simplified as shown in FIG. 6*b*.

We now have the following relationship between $T_{airflow}$ and $T_{trace}$:

$$\frac{P_{in} - k_{equ}(T_{trace} - T_{airflow})}{s\cdot 3m_0} = T_{trace}$$

Using the backward Euler method, $s=(1-z^{-1})/t$, $T_{trace}$ can be calculated every sampling time using the equation:

$$T_{trace}(i) = \frac{t_{sampling}(P_{in}(i) + T_{airflow}(i)\cdot k_{equ}) + 3m_0\cdot T_{trace}(i-1)}{3m_0 + t_{sampling}\cdot k_{equ}}$$

where X(i) is the variable value in the ith instant, and $t_{sampling}$ is the algorithm sampling time.

Outputting 112 a control signal based on the comparison of the predicted heater trace temperature to the desired heater trace temperature may provide a more responsive and/or more accurate system than, for example, a system where a control signal is output solely based on a comparison of a measured output airflow temperature to a desired output airflow temperature. By predicting the heater trace temperature using the measured output airflow temperature, the need for additional temperature sensors to directly measure the temperature of the heater traces 18,20,22 may be avoided. Thus better heater control may be achieved for little or no additional cost. Furthermore, it may be tricky to mount individual temperature sensors to each heater trace 18,20,22, and so predicting the heater trace temperature using the measured output airflow temperature may avoid additional manufacturing complexity.

Figure 7:
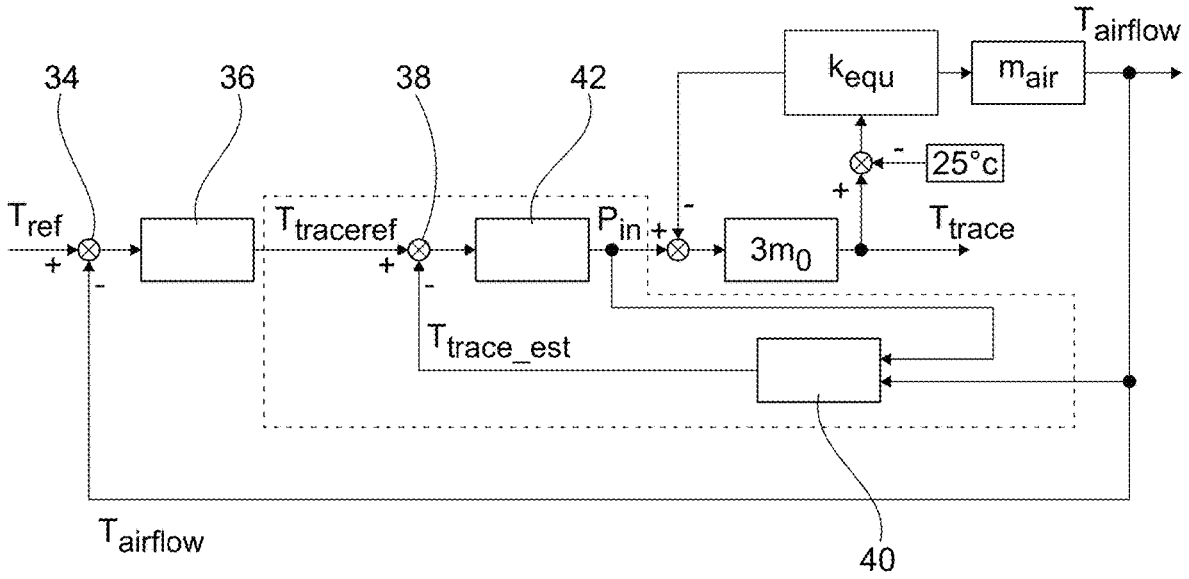
FIG. 7 is a first control block diagram of the method of FIG. 3.

The control structure can be seen schematically in more detail in FIG. 7. As can be seen, the desired output airflow temperature, $T_{ref}$, and the measured output airflow temperature, $T_{airflow}$, are fed to a first comparator 34, which outputs a signal to a first PI controller 36. The first PI controller 36 outputs a desired heater trace temperature, $T_{traceref}$, to a second comparator 38. The output airflow temperature, $T_{airflow}$, is also fed to an observer 40, along with the measured input power of the TRIACs, $P_{in}$, and the observer 40 outputs a predicted heater trace temperature $T_{trace_est}$, using the equation for $T_{trace}(i)$ discussed above, to the second comparator 38. The second comparator 38 outputs a signal to a second PI controller 42, which then outputs a power control signal to the TRIACs, thereby controlling the power supplied to the heater traces 18,20,22.

Figure 8:
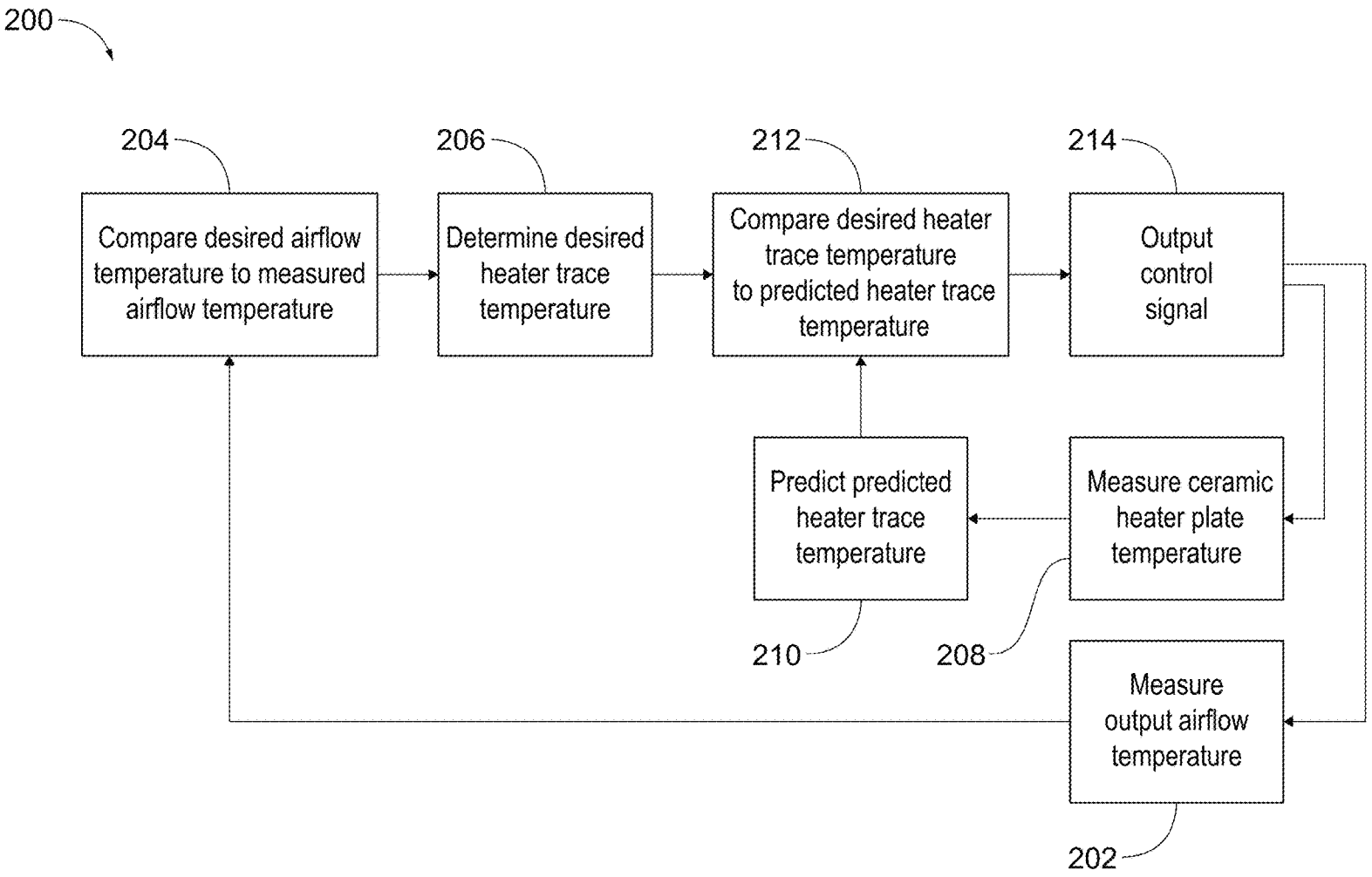
FIG. 8 is a flow chart illustrating a second embodiment of a method of controlling a haircare appliance according to the present invention.

An alternative embodiment of a method 200 according to the present invention can be seen schematically from the flow diagram of FIG. 8. The method 200 comprises measuring 202 a temperature of output airflow 30 of the hairdryer 10 to obtain a measured output airflow temperature. The measured output airflow temperature is compared 204 to a desired output airflow temperature, which may, for example, be set by a user choosing a mode of operation of the hairdryer 10 such as a heat setting. Based on this comparison, the controller 16 determines 206 a desired heater trace temperature to account for any difference between the measured output airflow temperature and the desired output airflow temperature.

The method 200 comprises measuring 208 a temperature of the ceramic heater plate 24, for example using the RTD 26, and using the measured ceramic heater plate temperature to predict 210 a predicted heater trace temperature. The controller 16 compares 212 the predicted heater trace temperature to the desired heater trace temperature, and outputs 214 a control signal to TRIACs (not shown) of the heater 14 to control the power supplied to the heater traces 18,20,22. In such a manner the method 200 may closely control the output airflow temperature via close control of the heater temperature, based on a predicted heater trace temperature determined by a measured ceramic plate temperature. The method 200 thus comprises two closed feedback loops, an outer feedback loop which controls the output airflow temperature, and an inner feedback loop which controls the heater trace temperature.

Figure 9:
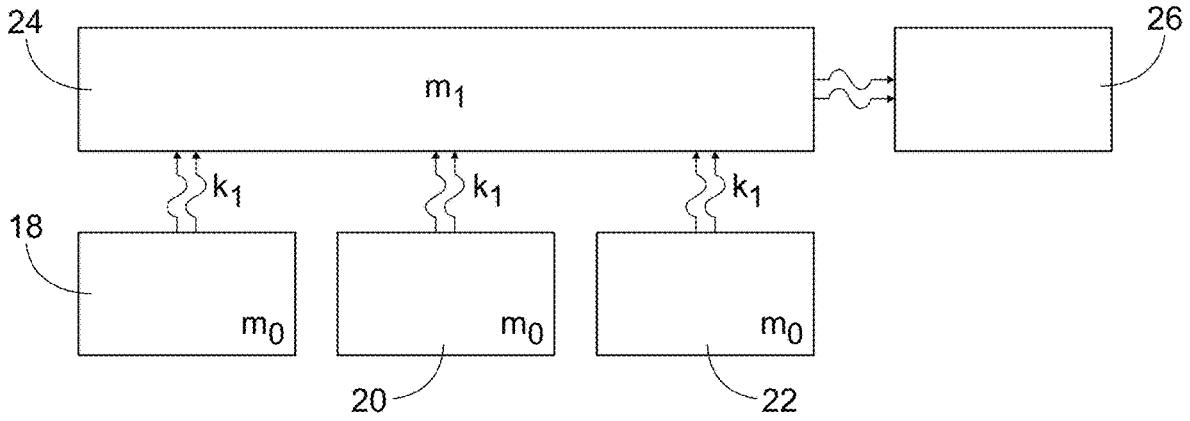
FIG. 9 is a second simplified version of the schematic heater representation of FIG. 2.

The method 200 described above relies on being able to predict a heater trace temperature using a measured ceramic heater plate temperature. This is achieved via a simplification of the schematic heater structure of FIG. 2, the simplification being shown in FIG. 9. As can be seen from FIG. 9, the parameters that need to be known are the thermal mass of the heater traces 18,20,22, $m_0$, the thermal mass of the ceramic heater plate 24, $m_1$, and the thermal conduction coefficient between the heater traces 18,20,22 and the ceramic heater plate 24, $k_1$.

Then, in a similar manner to that described above for calculating heater trace temperature from a measured output airflow temperature, the heater trace temperature can be calculated using the following equation:

$$\frac{P_{in} - (T_{trace} - T_{ceramic}) \cdot 3k_1}{3m_0 s} = T_{trace}$$

Using the backward Euler method, $s=(1-z^{-1})/t$, $T_{trace}$ can be calculated every sampling time using the equation:

$$T_{trace}(i) = \frac{t_{sampling}(P_{in}(i) + T_{ceramic}(i) \cdot 3k_1) + 3m_0 \cdot T_{trace}(i-1)}{3m_0 + t_{sampling} \cdot 3k_1}$$

where X(i) is the variable value in the ith instant, and $t_{sampling}$ is the algorithm sampling time.

Outputting 214 a control signal based on the comparison of the predicted heater trace temperature to the desired heater trace temperature may provide a more responsive and/or more accurate system than, for example, a system where a control signal is output solely based on a comparison of a measured output airflow temperature to a desired output airflow temperature. By predicting the heater trace temperature using the measured ceramic plate temperature, the need for additional temperature sensors to directly measure the temperature of the heater traces 18,20,22 may be avoided. Thus better heater control may be achieved for little or no additional cost. Furthermore, it may be tricky to mount individual temperature sensors to each heater trace 18,20,22, and so predicting the heater trace temperature using the measured output airflow temperature may avoid additional manufacturing complexity.

Predicting a heater trace temperature using a measured ceramic heater plate temperature may be beneficial over predicting a heater trace temperature using a measured output airflow temperature as the measured ceramic heater plate temperature may be unaffected by airflow characteristics which may affect a measured output airflow temperature. Thus predicting a heater trace temperature using a measured ceramic heater plate temperature may provide a more accurate prediction of the heater trace temperature than predicting a heater trace temperature using a measured output airflow temperature.

Figure 10:
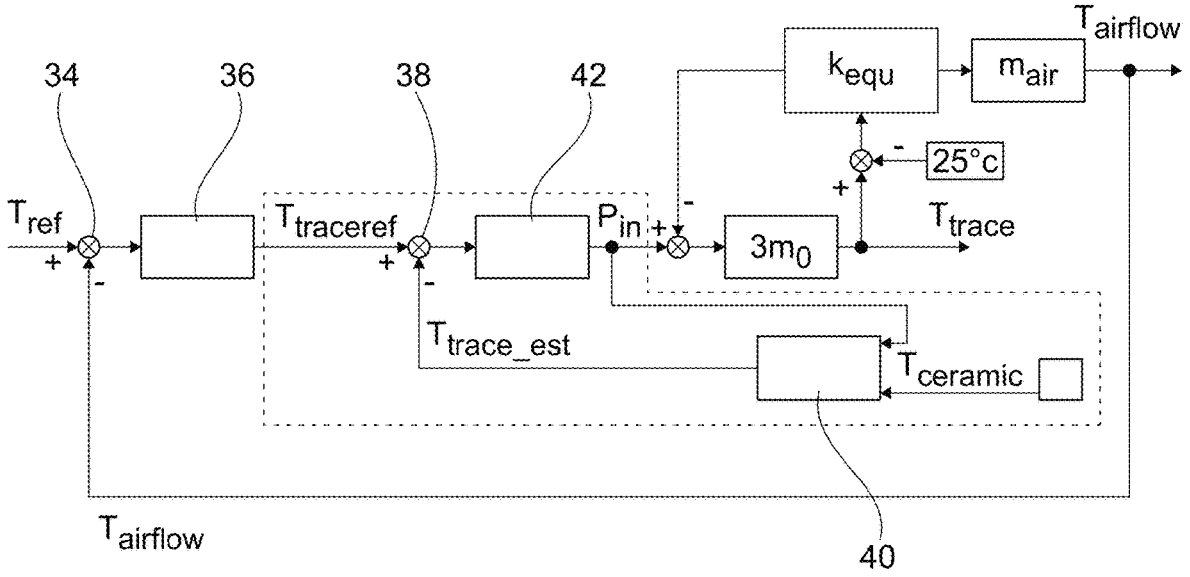
FIG. 10 is a first control block diagram of the method of FIG. 8.

The control structure can be seen schematically in more detail in FIG. 10. As can be seen, the desired output airflow temperature, $T_{ref}$, and the measured output airflow temperature, $T_{airflow}$, are fed to a first comparator 34, which outputs a signal to a first PI controller 36. The first PI controller 36 outputs a desired heater trace temperature, $T_{traceref}$, to a second comparator 38. A measured ceramic plate temperature is fed to an observer 40, along with the measured input power of the TRIACS, Pin, and the observer 40 outputs a predicted heater trace temperature $T_{trace_est}$, using the equation for $T_{trace}(i)$ discussed above, to the second comparator 38. The second comparator 38 outputs a signal to a second PI controller 42, which then outputs a power control signal to the TRIACS, thereby controlling the power supplied to the heater traces 18,20,22.

The invention claimed is:

1. A method of controlling a haircare appliance comprising a heater, wherein the method comprises measuring a temperature of output air of the haircare appliance to obtain a measured output air temperature, comparing the measured output air temperature to a desired output air temperature, determining a desired heater temperature based on the comparison of the measured output air temperature to the desired output air temperature, predicting a predicted heater temperature, comparing the predicted heater temperature to the desired heater temperature, and outputting a control signal based on the comparison of the predicted heater temperature to the desired heater temperature.

2. The method of claim 1, wherein the control signal comprises a power control signal for adjusting power supplied to the heater.

3. The method of claim 1, wherein the method comprises at least one of: (a) increasing power supplied to the heater where the predicted heater temperature is lower than the desired heater temperature, and (b) decreasing power supplied to the heater where the predicted heater temperature is higher than the desired heater temperature.

4. The method of claim 1, wherein determining a desired heater temperature based on the comparison of the measured output air temperature to the desired output air temperature comprises calculating an error value corresponding to a difference between the measured output air temperature and the desired output air temperature, and calculating a desired heater temperature to offset the error value.

5. The method of claim 1, wherein determining a desired heater temperature based on the comparison of the measured output air temperature to the desired output air temperature comprises utilising a first control compensator.

6. The method of claim 1, wherein outputting a control signal based on the comparison of the predicted heater temperature to the desired heater temperature comprises calculating an error value corresponding to a difference between the predicted heater temperature and the desired heater temperature, and calculating a control signal to offset the error value.

7. The method of claim 5, wherein outputting a control signal based on the comparison of the predicted heater temperature to the desired heater temperature comprises utilising a second control compensator.

8. The method of claim 1, wherein the method comprises a first control loop and a second control loop, the first control loop comprising measuring a temperature of output air of the haircare appliance to obtain a measured output air temperature, comparing the measured output air temperature to a desired output air temperature, and determining a desired heater temperature based on the comparison of the measured output air temperature to the desired output air temperature, and the second control loop comprising predicting a predicted heater temperature, comparing the predicted heater temperature to the desired heater temperature, and outputting a control signal based on the comparison of the predicted heater temperature to the desired heater temperature.

9. The method of claim 8, wherein the first control loop comprises an outer control loop, the second control loop comprises an inner control loop, and the first control loop is slower than the second control loop.

10. The method of claim 1, wherein predicting a predicted heater temperature comprises using the measured output air temperature to determine a predicted heater temperature.

11. The method of claim 1, wherein the heater comprises a heater trace, and the method comprises determining a desired heater trace temperature based on the comparison of the measured output air temperature to the desired output air temperature, predicting a predicted heater trace temperature, comparing the predicted heater trace temperature to the desired heater trace temperature, and outputting a control signal based on the comparison of the predicted heater trace temperature to the desired heater trace temperature.

12. The method of claim 11, wherein predicting a predicted heater trace temperature comprises using the measured output air temperature to predict a predicted heater trace temperature.

13. The method of claim 11, wherein the heater comprises a heat sink, and predicting a predicted heater trace temperature comprises using a measured heat sink temperature.

14. The method of claim 11, wherein the heater comprises a ceramic plate to which the heater trace is attached, and predicting a predicted heater trace temperature comprises using a measured ceramic plate temperature.

15. The method of claim 1, wherein the heater comprises a plurality of heater traces, and the method comprises determining a desired average heater trace temperature based on the comparison of the measured output air temperature to the desired output air temperature, predicting a predicted average heater trace temperature, comparing the predicted average heater trace temperature to the desired average heater trace temperature, and outputting a control signal based on the comparison of the predicted average heater trace temperature to the desired average heater trace temperature.

16. The method of claim 15, wherein predicting a predicted average heater trace temperature comprises using the measured output air temperature to predict a predicted average heater trace temperature.

17. The method of claim 15, wherein the heater comprises a heat sink, and predicting a predicted average heater trace temperature comprises using a measured heat sink temperature.

18. The method of claim 15, wherein the heater comprises a ceramic plate to which the heater trace is attached, and predicting a predicted average heater trace temperature comprises using a measured ceramic plate temperature.

19. The method of claim 15, wherein the control signal adjusts power supplied to each heater trace such that the power supplied to each heater trace is adjusted in an even manner.

20. A non-transitory computer readable storage medium comprising machine readable instructions for the operation of one or more processors of a controller of a haircare appliance to measure a temperature of output air of the haircare appliance to obtain a measured output air temperature, compare the measured output air temperature to a desired output air temperature, determine a desired heater temperature based on the comparison of the measured output air temperature to the desired output air temperature, predict a predicted heater temperature, compare the predicted heater temperature to the desired heater temperature, and output a control signal based on the comparison of the predicted heater temperature to the desired heater temperature.

21. A haircare appliance comprising a heater, a temperature sensor for measuring a temperature of output air of the haircare appliance, and a controller configured to measure a temperature of output air of the haircare appliance to obtain a measured output air temperature, compare the measured output air temperature to a desired output air temperature, determine a desired heater temperature based on the comparison of the measured output air temperature to the desired output air temperature, predict a predicted heater temperature, compare the predicted heater temperature to the desired heater temperature, and output a control signal based on the comparison of the predicted heater temperature to the desired heater temperature.

* * * * *